US005553725A

United States Patent [19]

Clemons

[11] Patent Number: 5,553,725

[45] Date of Patent: Sep. 10, 1996

[54] GLASS HAVING INNER AND OUTER COMPARTMENT

[76] Inventor: Keith P. Clemons, 17417 Red Oak Dr., #139, Houston, Tex. 77090

[21] Appl. No.: 341,882

[22] Filed: Nov. 15, 1994

[51] Int. Cl.[6] ..... A63F 7/00; A63F 7/30

[52] U.S. Cl. ..... 215/6; 229/400; 273/398

[58] Field of Search ..... 215/6, 385; 229/400; 220/506

[56] References Cited

U.S. PATENT DOCUMENTS

| | | | |
|---|---|---|---|
| 1,033,136 | 7/1912 | Wennersten | 220/426 X |
| 1,732,996 | 10/1929 | Wandel | 220/426 X |
| 2,151,856 | 3/1939 | Lee | 220/426 |
| 4,582,197 | 4/1986 | Lin | 229/103.1 |
| 4,869,390 | 9/1989 | Kennedy | 229/400 |
| 4,928,876 | 5/1990 | Marshall | 229/400 |
| 4,967,918 | 11/1990 | Long | 215/385 |
| 5,328,050 | 7/1994 | Hyatt | 220/506 |

*Primary Examiner*—Allan N. Shoap
*Assistant Examiner*—Christopher J. McDonald
*Attorney, Agent, or Firm*—Baker & Botts, L.L.P.

[57] ABSTRACT

A quarters glass has two compartments, one for receiving a liquid and the other for receiving a quarter which is bounced off a surface. A slot may be formed in the second compartment to permit the quarter to exit the glass. A guide may be connected to the slot to guide the quarter to a predetermined area.

3 Claims, 2 Drawing Sheets

GLASS HAVING INNER AND OUTER COMPARTMENT

BACKGROUND OF THE INVENTION

The game of "Quarters" is well known, especially among college students. Briefly stated, it is played by placing a glass on a table or other suitable surface and the players taking turns attempting to bounce a quarter off the surface into the glass. In many cases the glass is at least partially filled with a liquid, sometimes an alcoholic beverage such as "beer." Upon successfully bouncing the quarter into the glass, a player gets to choose who has the privilege of imbibing the liquid contained within the glass. One problem that is associated with this game is that usually the person designated to imbibe the liquid does so while the quarter is still within the glass. This creates the potential problem of the imbiber swallowing the quarter or transmitting germs. Additionally, the quarter gets coated with a liquid and at times can get sticky.

SUMMARY OF THE INVENTION

In order to overcome these and other disadvantages of the prior art, an improved quarters glass is disclosed. The improve quarters glass comprises two compartments, one for receiving liquid and a separate compartment for receiving the quarter. According to one preferred embodiment, the second compartment which receives the quarter may be provided with a slot which permits the quarter to exit from the glass (either vertically, horizontally or otherwise). According to yet another embodiment, the slot may be associated with a guide which may be positioned in front of the player shooting the quarter to facilitate the return of the quarter to that player. These and other objects and embodiments of the invention are described below in connection with the detailed description of the invention and with reference to the drawings. The following are preferred embodiments only and the invention is not limited to these embodiments.

DETAILED DESCRIPTION PREFERRED EMBODIMENTS

Figure 1:
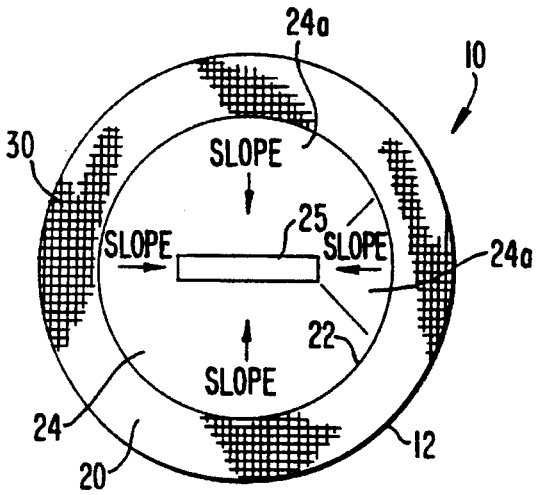
FIG. 1 is a top view of the improved quarters glass according to one embodiment of the present invention.
Figure 2:
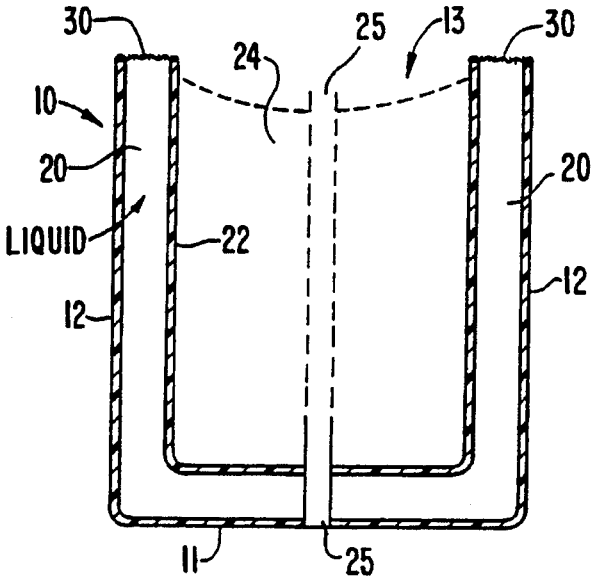
FIG. 2 is a perspective view of the glass of FIG. 1.
Figure 3:
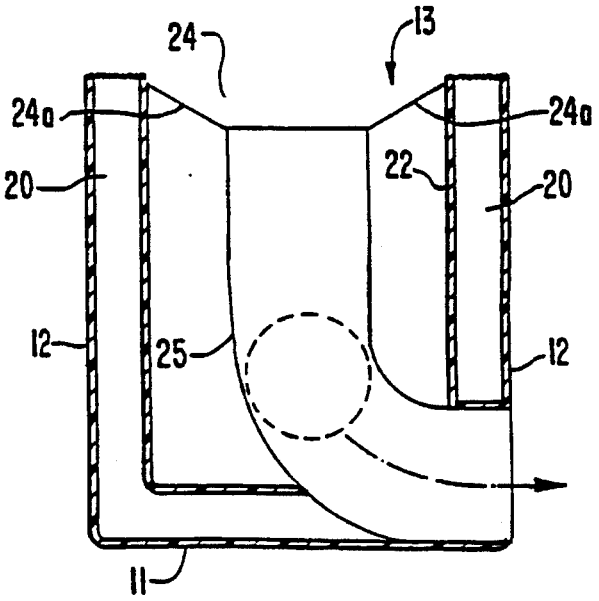
FIG. 3 is a sectional view of the glass shown in FIGS. 1 and 2.

With reference to FIGS. 1–3, one embodiment of the invention is shown. The glass, generally referred to as 10, includes a base 11, side walls 12 and an opening 13 at an open end. The term "glass" is used herein in a broad context to include generally any liquid container. It may take many shapes or forms including a generally cylindrical structure, a structure which converges from an opening to the base, a structure which converges from the base to the opening or which has some other curvilinear characteristic defining its outer walls. Additionally, the term "glass" does not necessarily imply that the container must be made of glass, but may preferably be made of plastic or other suitable materials. According to one embodiment of the present invention, a first compartment 20 is defined as an area between an outer wall 12 and an interior wall 22, which along any plane may define a generally annular region. Additionally, a second compartment 24 is formed and is defined by the inner wall 22 and the space contained inwardly of the inner wall 22. Preferably the second compartment 24 contains sloped walls **24*a* leading to a slot 25, although this feature is not necessary. As shown for example in FIG. 3, the slot 25 may be formed to cause a quarter entering therein to exit through a portion of the glass. This may be through a side of the glass, through the bottom of the glass or otherwise. The sloped walls 24*a* of the second compartment, if provided, facilitate the quarter entering the slot 25**.

According to another preferred, but optional feature, the first compartment may be provided with a plastic (or other suitable material) mesh 30 to ensure that the quarter does not enter the first compartment 20. Alternatively, or in addition thereto, the first compartment 20 may be sized to reduce the chances that the quarter will enter the first compartment 20. The overall diameter of the open end of the glass (if the open end is generally circular, though this is not necessary) is preferably about three and half inches. Preferably, the glass has a dimension from the outer wall of the base to the plane of the open end of approximately three and three eighths inches. Preferably, the distance between the outer wall and the inner wall is about three quarters of an inch (¾") or about 1.9 cm. The mesh 30, if used, is preferably removably securable to the glass or may be permanently or semi-permanently attached to the glass. For example, the mesh 30 may be a generally annular piece of material which fits over the first compartment 20 and may extend a certain distance down the outer side walls of the glass. This distance is optional and may be a short distance (on the order of a fraction of an inch) to a distance sufficient to permit the mesh to wrap around the side walls and all or at least a portion of the base of the glass.

Optionally, the second compartment may be provided with an insert (not shown), preferably having sloped inner walls and a slot at the bottom of the insert. The insert preferably has outer walls which substantially correspond to the boundary of the second compartment to permit selective removal of the insert from the glass.

Figure 4:
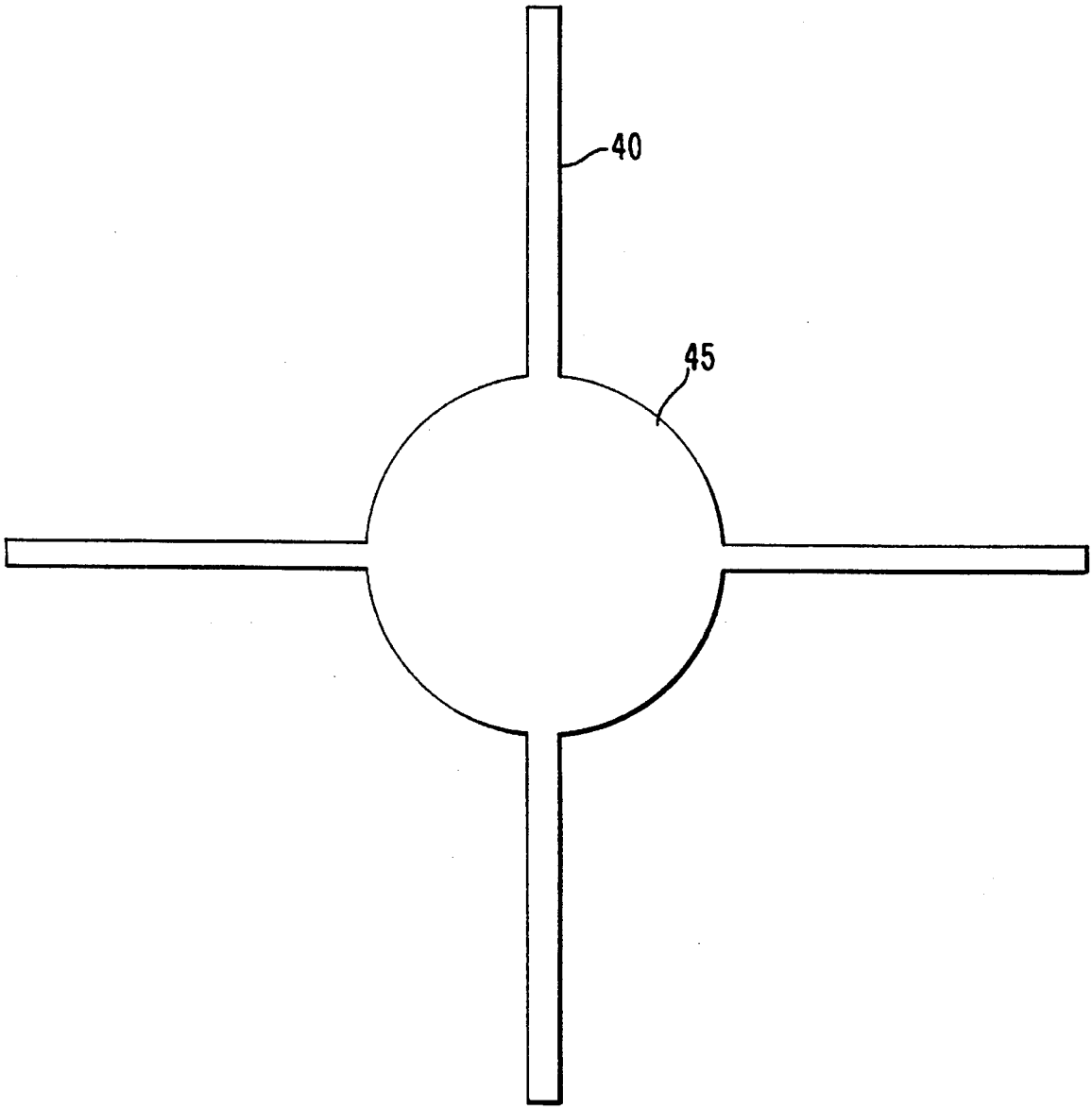
FIG. 4 discloses an optional embodiment with the use of one or more guides to return the quarter to the player.

As shown for example in FIG. 4, according to another preferred embodiment, the slot 25 may lead to a guide 40 which is pivotally attached to a portion of the glass or a base 45 upon which the glass may rest so that upon proper rotation of the glass the guide will be aligned with the player shooting the quarter. In this way, upon successfully bouncing the quarter into the glass, the quarter will be delivered through the slot into the guide and returned to an area in front of the appropriate player. Alternatively, plural guides may be attached to the glass.

The foregoing, is a description of the preferred embodiment of the present invention. It is to be understood, however, that various modifications and improvements will be readily apparent to one of ordinary skill in the art. The choice of materials, the size of the glass and the proportions thereof, including the compartments, the slot, the guide, the position of the guide(s) and various other features may be modified without departing from the scope of the invention. Additionally, if it is desired to use an object other than a quarter, the design considerations including dimensions, shape, etc. may be similarly modified to accommodate the size of the desired object. The invention is only limited by the claims appended hereto.

I claim:

1. A glass comprising:

a first compartment for receiving a liquid, said first compartment being defined by an outer wall and an inner wall;

a second compartment for receiving an object, said second compartment located inwardly of said first compartment and being defined by said inner wall, and a slot connected to said second compartment and extending from an upper portion of said second compartment through a portion of said outer wall of the glass to permit said object entering said second compartment to exit through said outer wall of said glass.

2. The glass of claim 1 further comprising a means for ensuring that the object does not enter the first compartment.

3. A glass comprising:

a first compartment for receiving a liquid, said first compartment being defined by an outer wall and an inner wall;

a second compartment for receiving an object, said second compartment located inwardly of said first compartment and being defined by said inner wall and a bottom wall;

a slot having a first end opening into said second compartment and a second end extending through said outer wall, said slot permitting said object entering said second compartment to exit through said outer wall of the glass; and a sloping wall connected between said second compartment and said first end of said slot for facilitating entry of said object into the slot.

* * * * *